US007222745B2

(12) United States Patent
Gutierrez et al.

(10) Patent No.: US 7,222,745 B2
(45) Date of Patent: May 29, 2007

(54) PLASTIC BOXES AND METHODS FOR MAKING SAME

(75) Inventors: Felix Z. Gutierrez, Bentonville, AR (US); Jerry D. Maxey, Rogers, AR (US)

(73) Assignee: Wal-Mart Stores, Inc., Bentonville, AR (US)

( * ) Notice: Subject to any disclaimer, the term of this patent is extended or adjusted under 35 U.S.C. 154(b) by 410 days.

(21) Appl. No.: 10/744,453

(22) Filed: Dec. 23, 2003

(65) Prior Publication Data

US 2005/0133515 A1 Jun. 23, 2005

(51) Int. Cl.
*B65D 6/00* (2006.01)
*B65D 1/42* (2006.01)
*B65D 8/08* (2006.01)

(52) U.S. Cl. ..... 220/675; 220/645; 220/652

(58) Field of Classification Search ..... 220/675, 220/652, 645, 508, 278; 206/508, 278
See application file for complete search history.

(56) References Cited

U.S. PATENT DOCUMENTS 2,333,643 A * 11/1943 Donnellan ..... 383/38
3,063,550 A * 11/1962 Boden et al. ..... 206/296
3,244,311 A * 4/1966 Lawson ..... 220/4.21
3,303,965 A * 2/1967 Parker et al. ..... 206/511
3,331,529 A * 7/1967 Slapnik ..... 206/508
3,412,888 A * 11/1968 Andrews et al. ..... 220/4.21
3,419,184 A * 12/1968 Asenbauer ..... 206/508
3,420,431 A * 1/1969 Donovan ..... 229/407
3,568,879 A * 3/1971 Box ..... 206/504
3,586,205 A * 6/1971 Van Daalen ..... 206/508
3,680,735 A * 8/1972 Lucas ..... 206/511
3,759,416 A * 9/1973 Constantine ..... 206/505
3,822,029 A * 7/1974 Butsch ..... 220/675
3,870,188 A * 3/1975 Buffett ..... 220/675
4,113,095 A * 9/1978 Dietz et al. ..... 206/508
4,632,242 A * 12/1986 Choi et al. ..... 206/45.24
4,676,371 A * 6/1987 Byrne ..... 312/49
4,728,559 A * 3/1988 Hardenbrook et al. ..... 428/159
4,795,029 A * 1/1989 Campbell et al. ..... 206/278
4,819,795 A * 4/1989 Swaney ..... 206/278

(Continued)

FOREIGN PATENT DOCUMENTS

GB 2057669 1/1996

(Continued)

*Primary Examiner*—Anthony D. Stashick
*Assistant Examiner*—Shawn M Braden
(74) *Attorney, Agent, or Firm*—Priest & Goldstein, PLLC

(57) ABSTRACT

A box includes a base having a substantially rectangular perimeter. A pair of side walls and a pair of end walls extend upward from the perimeter of the base to form a box bottom having rounded corners and vertices. The box bottom includes a mouth at the top thereof. The mouth has a substantially rectangular perimeter. Reinforcing ridges are formed at the corners and vertices of the box bottom, and a lip formed at the perimeter of the mouth. A lid fits over the mouth of the box bottom. The lid includes a collar having a cuff that engages the lip to hold the lid in position over the mouth of the box bottom. At least one air hole is formed in the base and in the lid. A plurality of inwardly protruding panels is formed in the lid and in the base and walls of the box bottom.

6 Claims, 11 Drawing Sheets

U.S. PATENT DOCUMENTS

| | | | | | |
|---|---|---|---|---|---|
| 4,844,263 | A | * | 7/1989 | Hadtke | 206/508 |
| 4,848,580 | A | * | 7/1989 | Wise | 206/519 |
| D311,684 | S | | 10/1990 | Newell et al. | |
| 5,012,928 | A | * | 5/1991 | Proffitt et al. | 206/508 |
| 5,197,661 | A | * | 3/1993 | Sanchez | 229/162.4 |
| 5,197,681 | A | | 3/1993 | Sanchez | |
| D344,890 | S | * | 3/1994 | Townes | D9/418 |
| 5,366,107 | A | * | 11/1994 | Rostkowski | 220/676 |
| D361,036 | S | * | 8/1995 | Krupa | D9/424 |
| D363,879 | S | * | 11/1995 | Krupa et al. | D9/423 |
| 5,564,805 | A | * | 10/1996 | Dickinson | 312/249.8 |
| 5,590,766 | A | * | 1/1997 | Carnahan et al. | 206/296 |
| 5,641,090 | A | * | 6/1997 | Kowalski et al. | 220/782 |
| D397,552 | S | * | 9/1998 | Rutledge | D3/302 |
| 5,842,575 | A | * | 12/1998 | Dressen et al. | 206/711 |
| D406,463 | S | * | 3/1999 | Rutledge | D3/302 |
| D409,485 | S | * | 5/1999 | Christy, Jr. | D9/425 |
| 6,007,854 | A | * | 12/1999 | Cadiente et al. | 426/106 |
| 6,074,676 | A | * | 6/2000 | Cadiente et al. | 426/106 |
| D427,769 | S | | 7/2000 | Zimmerman | |
| 6,138,863 | A | * | 10/2000 | Aiken | 220/819 |
| 6,170,696 | B1 | * | 1/2001 | Tucker et al. | 220/793 |
| 6,273,291 | B1 | * | 8/2001 | Conti | 220/781 |
| 6,308,858 | B1 | * | 10/2001 | Koefelda | 220/608 |
| D466,299 | S | * | 12/2002 | Zimmerman | D3/302 |
| D478,282 | S | * | 8/2003 | Hayes et al. | D9/425 |
| 6,644,494 | B2 | * | 11/2003 | Hayes et al. | 220/839 |
| D490,309 | S | * | 5/2004 | Hayes et al. | D9/425 |
| 6,845,878 | B2 | * | 1/2005 | Hayes et al. | 220/839 |
| D503,042 | S | * | 3/2005 | Gutierrez et al. | D3/302 |
| D503,534 | S | * | 4/2005 | Dong | D3/276 |
| D508,260 | S | * | 8/2005 | Toth | D19/2 |
| 2002/0020709 | A1 | * | 2/2002 | Huang et al. | 220/675 |
| 2002/0070223 | A1 | * | 6/2002 | Elvin-Jensen et al. | 220/669 |
| 2002/0092787 | A1 | * | 7/2002 | Cheng | 206/459.5 |
| 2003/0183641 | A1 | * | 10/2003 | Asbury | 220/781 |
| 2004/0118737 | A1 | * | 6/2004 | Welsh et al. | 206/508 |
| 2004/0262322 | A1 | * | 12/2004 | Middleton et al. | 220/675 |

FOREIGN PATENT DOCUMENTS

| | | |
|---|---|---|
| GB | 2057670 | 1/1996 |
| GB | 3000064 | 12/2001 |
| GB | 3006224 | 8/2002 |
| GB | 3007256 | 9/2002 |
| GB | 3011578 | 3/2003 |
| GB | 3011579 | 3/2003 |

* cited by examiner

PLASTIC BOXES AND METHODS FOR MAKING SAME

BACKGROUND OF THE INVENTION

1. Field of the Invention

The present invention relates generally to the field of packaging, and more particularly to advantageous aspects of an improved plastic box and methods for making same.

2. Description of Prior Art

In current designs, boxes for retail items, such as shoes, are commonly fabricated from cardboard. There are a number of reasons that cardboard is used rather than plastic. First, cardboard boxes are relatively inexpensive, yet strong enough to allow multiple boxes to be stacked on top of each other. Further, cardboard boxes are typically breathable, preventing a buildup of moisture within the box that could lead to mildew, mold, or other damage to the boxes' contents.

However, cardboard boxes suffer from a number of disadvantages. First, cardboard boxes tend to lack esthetic appeal. Although it is possible to apply graphics and other designs to the exterior of a cardboard box, the appearance of a cardboard box is often spoilt when the box becomes even slightly worn or damaged. Also, cardboard boxes typically have unfinished or plain white interiors. One reason for this is that the use of a colored box interior carries with it the risk that the interior colors may migrate onto the contents of the box.

Plastic has not been a favored material for use in fabricating boxes and lids to hold certain types of retail items, such as shoes. One reason is that plastic boxes may be more expensive to manufacture than cardboard boxes. In addition, plastic boxes may lack the structural strength of a comparably sized cardboard box. Further, a plastic box may not be sufficiently breathable to prevent mildew or mold from forming on the box contents.

SUMMARY OF THE INVENTION

These and other issues are addressed by the present invention, aspects of which provide a package including a base having a substantially rectangular perimeter. A pair of side walls and a pair of end walls extend upward from the perimeter of the base to form a box bottom having rounded corners and vertices. The box bottom includes a mouth at the top thereof. The mouth has a substantially rectangular perimeter. Reinforcing ridges are formed at the corners and vertices of the box bottom, and a lip is formed at the perimeter of the mouth. A lid fits over the mouth of the box bottom. The lid includes a collar having a cuff that engages the lip to hold the lid in position over the mouth of the box bottom. At least one air hole is formed in the base of the box bottom and in the lid, and a plurality of inwardly protruding panels is formed in the lid and in the base and walls of the box bottom.

Additional features and advantages of the present invention will become apparent by reference to the following detailed description and accompanying drawings.

BRIEF DESCRIPTION OF THE DRAWINGS

FIG. 8 shows the box in a closed configuration, and FIG. 9 shows the box in an open configuration in which the lid has been positioned under the bottom exterior face of the box bottom.

DETAILED DESCRIPTION

Figure 1:
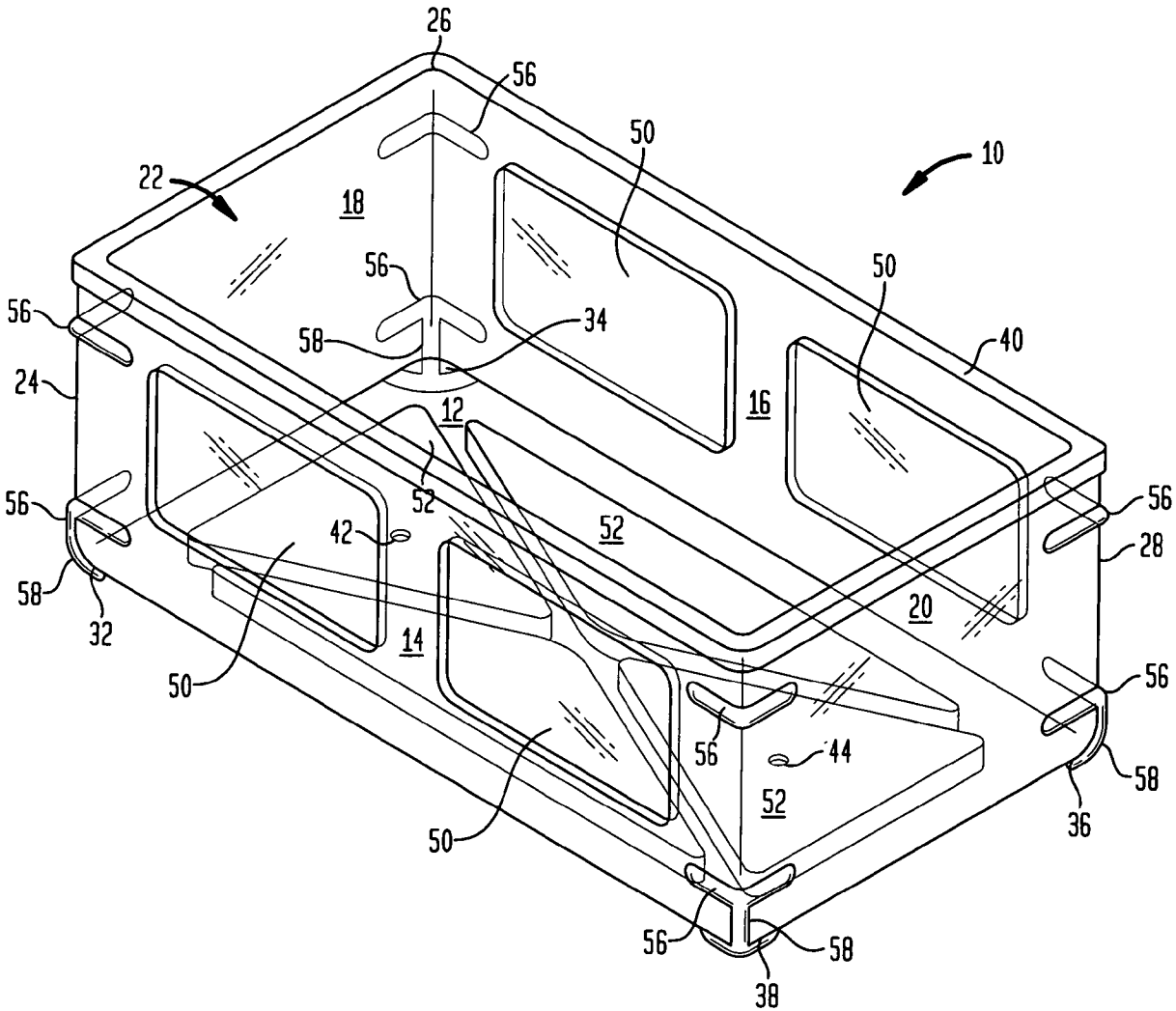
FIGS. 1 and 2 show perspective views of a box bottom and lid, respectively, according to a first aspect of the invention.

An aspect of the present invention provides a box bottom and lid for holding retail items, such as shoes, or the like. As described below, the box bottom and lid include structural components that allow the box bottom and the lid to be fabricated relatively inexpensively out of plastic using a thermoforming technique, while still having sufficient strength to allow numerous boxes to be stacked on top of each other. In addition, the box bottom and lid are designed so that the box they form is breathable, thus tending to prevent the box's contents from developing mold or mildew.

It should be noted that even apparently moisture-resistant retail items, such as athletic shoes, may retain some moisture. This moisture may be introduced into the retail items, for example, as part of the item's manufacturing process. Also, during packaging, shipment, and storage, retail items are typically subjected to a wide range of temperatures and humidities. Thus, for example, if the retail items are packaged under high humidity conditions, a certain amount of moisture may be trapped inside the box, which can subsequently lead to the development of mildew or mold during shipment or storage.

According to a further aspect of the invention, the box bottom and lid are fabricated from a transparent plastic material so that the box's contents are visible from the exterior of the box. The transparency of the box material serves an esthetic function, as a transparent box is typically more visually appealing than a typical cardboard box. In addition, the transparency of the box material is useful because it allows store employees and customers to view the contents of the box without having to open it. Also, a transparent box according to the invention may be tinted, if desired, to enhance its visual appeal, or to separate boxes into different styles, sizes, or other categories. For example, different shoe sizes can be color coded to avoid misshelving when items are hurriedly returned to inventory, and also to allow store employees to readily identify misshelved boxes when inventory is being checked.

In a typical thermoforming technique, sheets or rolls of suitable plastic material are heated and then pressed into a suitable mold. The use of a thermoforming technique is advantageous because it allows boxes and lids according to the present invention to be manufactured quickly and economically. According to an aspect of the present invention, a thermoforming technique is used to fabricate each of the box bottom and the lid as a seamless, completely formed unit.

It should be noted that the manufacture of a typical cardboard box is a multi-step process. In a first step, a sheet of cardboard is cut and scored to form a blank, having panels and glue flaps separated by score lines. The blank must then be folded into a box shape, and the glue flaps must then be glued into position. Thus, the use of a thermoforming technique may significantly reduce the amount of time and labor required to manufacture a box.

As mentioned above, thermoformed plastic boxes have typically lacked the strength and breathability required for many retail packaging applications. However, as discussed in detail below, an aspect of the present invention provides a box bottom and lid in which a thermoforming process is used to form certain structural elements in the box bottom and lid that enhance the strength and breathability of the box. Suitable materials for thermoforming include, but are not limited to, such materials as polypropylene, polyvinyl chloride (PVC) amorphous polyethylene terephalate (APET) or polyethyleneterephthalateglycolate (PETG).

According to a further aspect of the invention, the box bottom and lid are fabricated from sheets of plastic having different thicknesses. In particular, it has been found that a thicker material may be used for the lid than for the box bottom. The added thickness of the lid material increases the strength and durability of the lid. It would also be within the spirit of the invention, if desired, to use different materials for the box bottom and lid. The box bottoms and lids illustrated in FIGS. 1–17 and discussed below were fabricated from PVC. It has been found that suitable thicknesses for the material were as follows:

Four sides of the shoe box: 0.5–0.6 mm

Bottom of the shoe box: 0.4–0.5 mm

Lid of the shoe box: 0.7–0.75 mm

Figure 2:
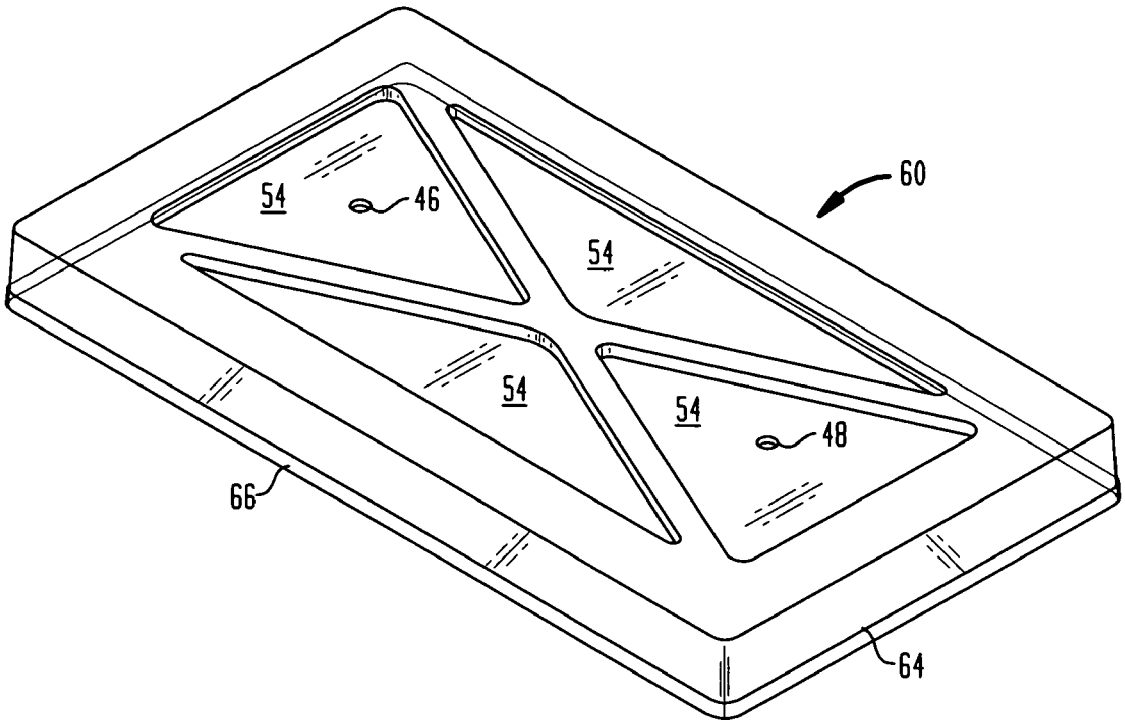

FIGS. 1 and 2 show, respectively, perspective views of a box bottom 10 and a lid 60 according to a first aspect of the invention. The box bottom 10 includes a base 12 that is substantially rectangular in shape. Extending upward from the four side edges of the base 12 are first and second side walls 14 and 16 and first and second end walls 18 and 20. The term "wall" is used herein to refer generally to any of side walls 14 and 16 and end walls 18 and 20. The base and four walls together form a box bottom with a substantially rectangular mouth 22 opposite the base 12. Each of the four walls 14, 16, 18 and 20 are joined at their side edges to an adjacent wall at four corners 24, 26, 28 and 30. The corners of the base 12 meet the bottom corners of the four walls 14, 16, 18 and 20 to form vertices 32, 34, 36, and 38. According to an aspect of the invention, each of the four corners 24, 26, 28 and 30 and each of the four vertices 32, 34, 36 and 38 are rounded.

The box bottom 10 further includes a lip 40 formed at the perimeter of the mouth 22. The lip 40 may be formed, for example, by folding over the upper edge of the box bottom 10 during the forming process. The lip 40 serves to reinforce the mouth 22. The lip 40 also provides a structure that can be used to hold the lid 60 in place.

FIG. 2 shows a perspective view of a lid 60 according to an aspect of the invention. It will be seen that the lid 60 is shaped to fit closely over the mouth 22 of the box bottom 10. The lid includes a base 62, and a collar 64 extending downward from the perimeter of the base 62. The bottom edge of the collar 64 terminates in a cuff 66. The cuff 66 is dimensioned and positioned to grip the lip 40 of the box bottom 10 when the lid 60 is placed onto the box bottom 10. According to a further aspect of the invention, the lid 60 is fabricated from a material having a thickness that is greater than the thickness of the material used to fabricate the box bottom 10. This extra thickness adds strength to the lid 60, facilitating the stacking of boxes on top of each other.

As shown in FIGS. 1 and 2, the box bottom 10 and lid 60 include a plurality of air holes 42, 44, 46 and 48. According to the present aspect of the invention, a first pair of air holes 42 and 44 is located in the base 10 and a second pair of air holes 46 and 48 is located in the lid 60. As described below, the air holes 42, 44, 46 and 48 combine with other structural elements, described herein, to provide ventilation for the box contents without significantly detracting from the box's strength or esthetic appearance. As mentioned above, proper ventilation tends to prevent formation of mildew, mold, or other moisture-related damage to the box contents. The air holes may be formed, for example, by using a punch, or similar device, to cut holes into the box bottom 10 and lid 60 after they have been thermoformed.

As further shown in FIGS. 1 and 2, the box bottom and lid include a plurality of panels 50, 52 and 54 that protrude slightly into the interior of the box bottom 10 and lid 60. The panels 50, 52 and 54 are formed by making suitable indentations in the box bottom 10 and lid 60 during the thermoforming process. As shown in FIGS. 1 and 2, the panels are located in the lid 60 and in the base 12 and side walls 14 and 16 of the box bottom 10.

According to the present aspect of the invention, the end walls 18 and 20 are smooth. Thus, the contents of the box bottom 10 may be viewed, without distortion, through the end walls 18 and 20 when a transparent material is used to fabricate the box bottom 10. Viewing the box contents through an end wall may be useful, for example, where the boxes are stacked on a shelf. In addition, the use of a smooth end wall allows a label or other printed or decorative material to be easily adhered to the end wall. In addition, it will be appreciated that a transparent box bottom 10 may be used with a translucent or opaque lid 60 or vice versa. Also, the box bottom 10 and lid 60 may be different colors or tints.

The panels 50, 52 and 54 serve a number of purposes. First, the panels 50, 52 and 54 serve to increase the strength of the base 12, walls 14, 16, 18 and 20, and lid 50. Specifically, the presence of panels 50, 52 and 54 tends to prevent any of these surfaces from buckling or deforming when weight is applied to the box. In addition, it will be seen that the panels 50, 52 and 54 tend to lift the box's contents away from the interior surfaces of the box. Thus, the panels 50, 52 and 54 tend to facilitate the circulation of air and removal of moisture. In addition, the panels 50, 52 and 54 tend to prevent retail items from sticking or otherwise adhering to the interior surfaces of the box.

Figure 3:
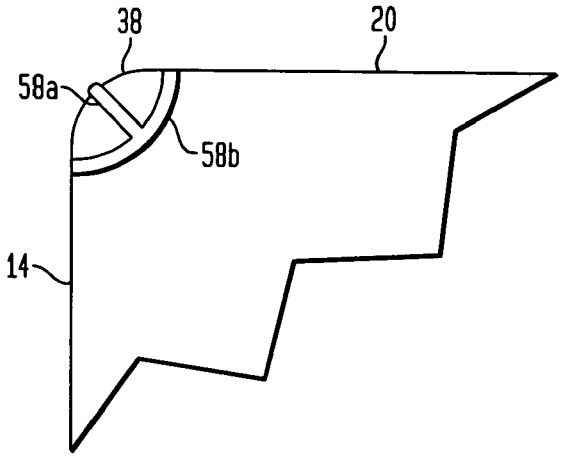
FIG. 3 shows a bottom view of a corner of the box bottom shown in FIG. 1.

As further shown in FIG. 1, the box bottom 10 includes a plurality of supporting ridges 56 located at corners 24, 26, 28 and 30. The box bottom 10 further includes supporting ridges 58 at the box's bottom vertices 32, 34, 36 and 38. FIG. 3 shows a partial bottom view of the box bottom 10 shown in FIG. 1, illustrating vertex supporting ridges 58*a* and 58*b* according to a further aspect of the invention. Ridge 58*a* is referred to herein as a "radial ridge" because it extends radially from the vertex 38 towards the interior of the box bottom 10. The radial ridge 58*a* terminates at a second ridge 58*b*. The second ridge 58*b* is referred to herein as a "circumferential ridge" because it extends circumferentially around the vertex 38. The supporting ridges 56 and 58 add strength to the corners and vertices of the box bottom 10, while not significantly detracting from the overall esthetic appearance of the box. The ridges 56 and 58 may be easily fabricated as part of the overall forming technique. The ridges 56 58 are elevated slightly towards the exterior of the box.

Figure 4:
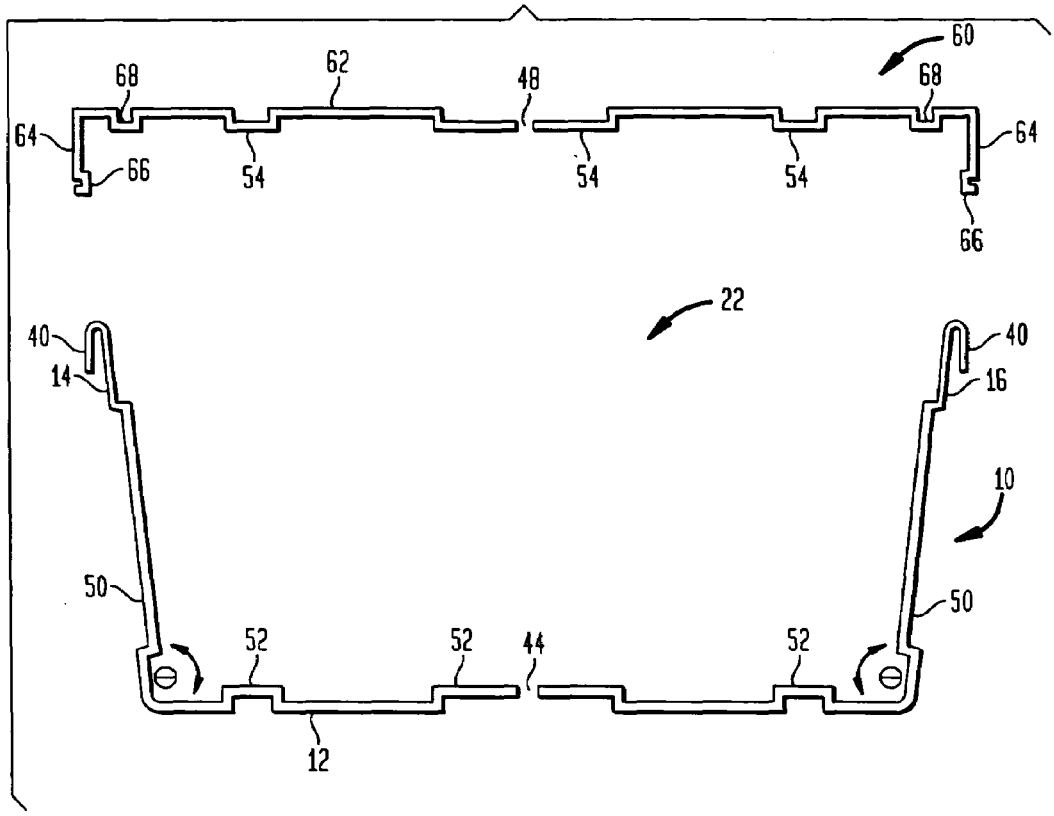
FIG. 4 shows a cross section of the box bottom and lid shown in FIGS. 1 and 2 in an open configuration.
Figure 5:
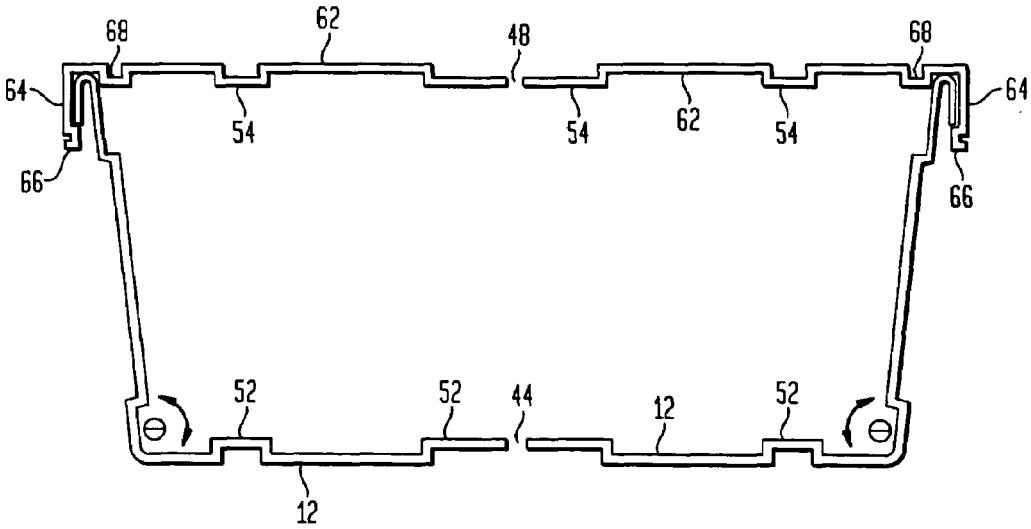
FIG. 5 shows a cross section of the box bottom and lid shown in FIGS. 1 and 2 in a closed configuration.

The structural components of the box bottom and lid discussed above can be better understood with reference to FIGS. 4 and 5, which show axial cross sections of the box bottom 10 and lid 60 shown in FIGS. 1 and 2, through air holes 44 and 48. In FIG. 4, the box bottom 10 and lid 60 are in an open configuration. In FIG. 5, the box bottom 10 and lid 60 are in a closed configuration.

FIGS. 4 and 5 illustrate the interaction between the cuff 66 on the lid 60 and the lip 40 on the box bottom 10. As shown in FIGS. 4 and 5, the cuff 66 is dimensioned such that its perimeter is slightly smaller than the perimeter of the lip 40. Because the box bottom 10 and lid 60 are fabricated from a deformable, resilient plastic material, the cuff 66 may be slid down over the lip 40. When the cuff 66 clears the lip 40, the resiliency of the plastic material causes the lip 40 to engage the cuff 66. The cuff 66 and lip 40 are dimensioned such that the lid 60 may be subsequently removed from the box bottom 10 with a reasonably small amount of effort. As shown in FIGS. 3 and 4, a ridge 68 may be added to the lid 60 to enhance the gripping action between the lid 60 and the lip 40.

As further illustrated in FIGS. 4 and 5, according to a further aspect of the invention, the angle θ between the base 12 and the walls 14, 16, 18 and 20 is slightly greater than 90 degrees. This arrangement serves a number of purposes. First, it facilitates the use of a thermoforming technique to manufacture the box bottom 10, because it allows the box bottom 10 to be easily removed from a mold. Second, this arrangement allows multiple empty box bottoms 10 to be stacked in a nesting configuration to minimize storage space.

Figure 6:
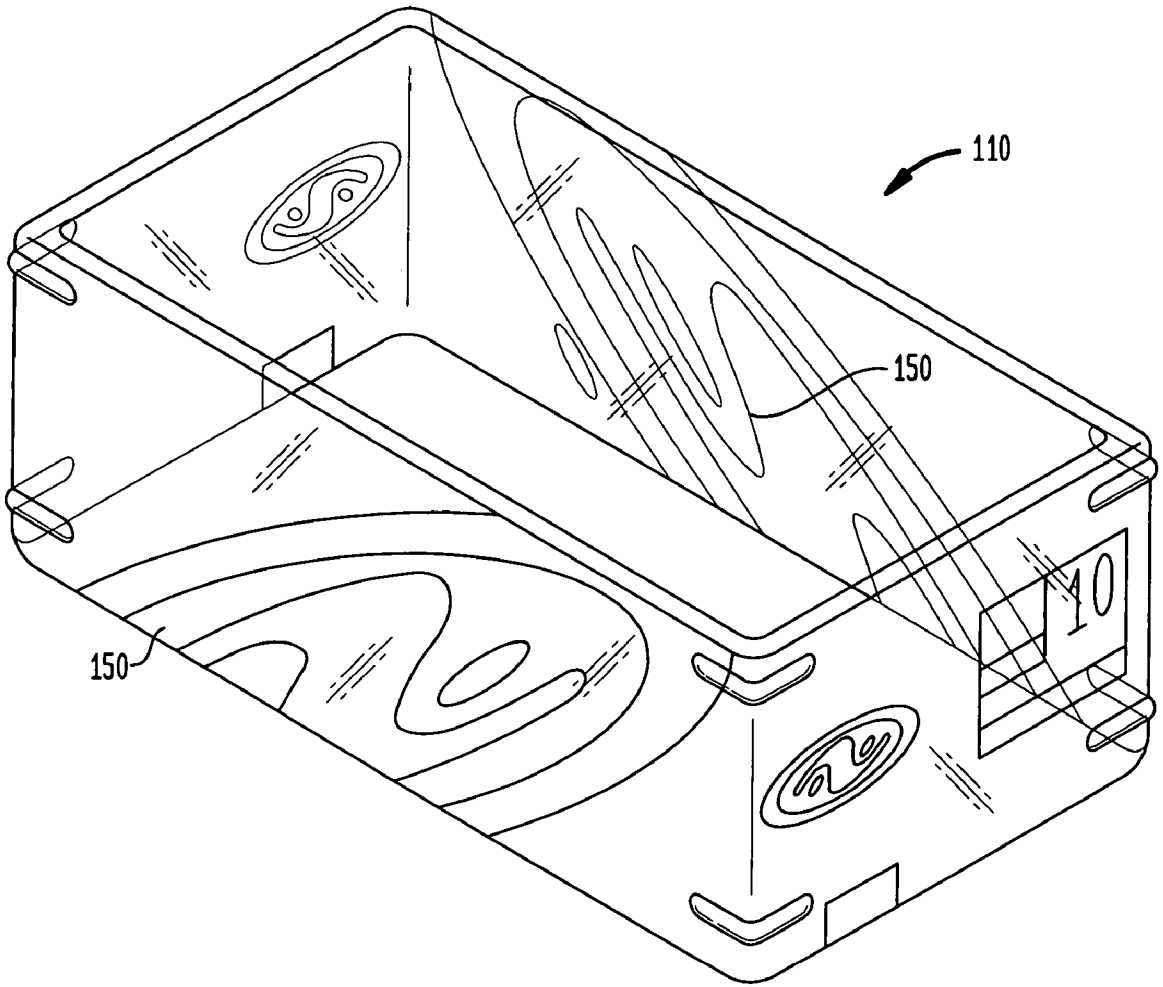
FIGS. 6 and 7 show perspective views of a box bottom and lid according to a further aspect of the invention.
Figure 7:
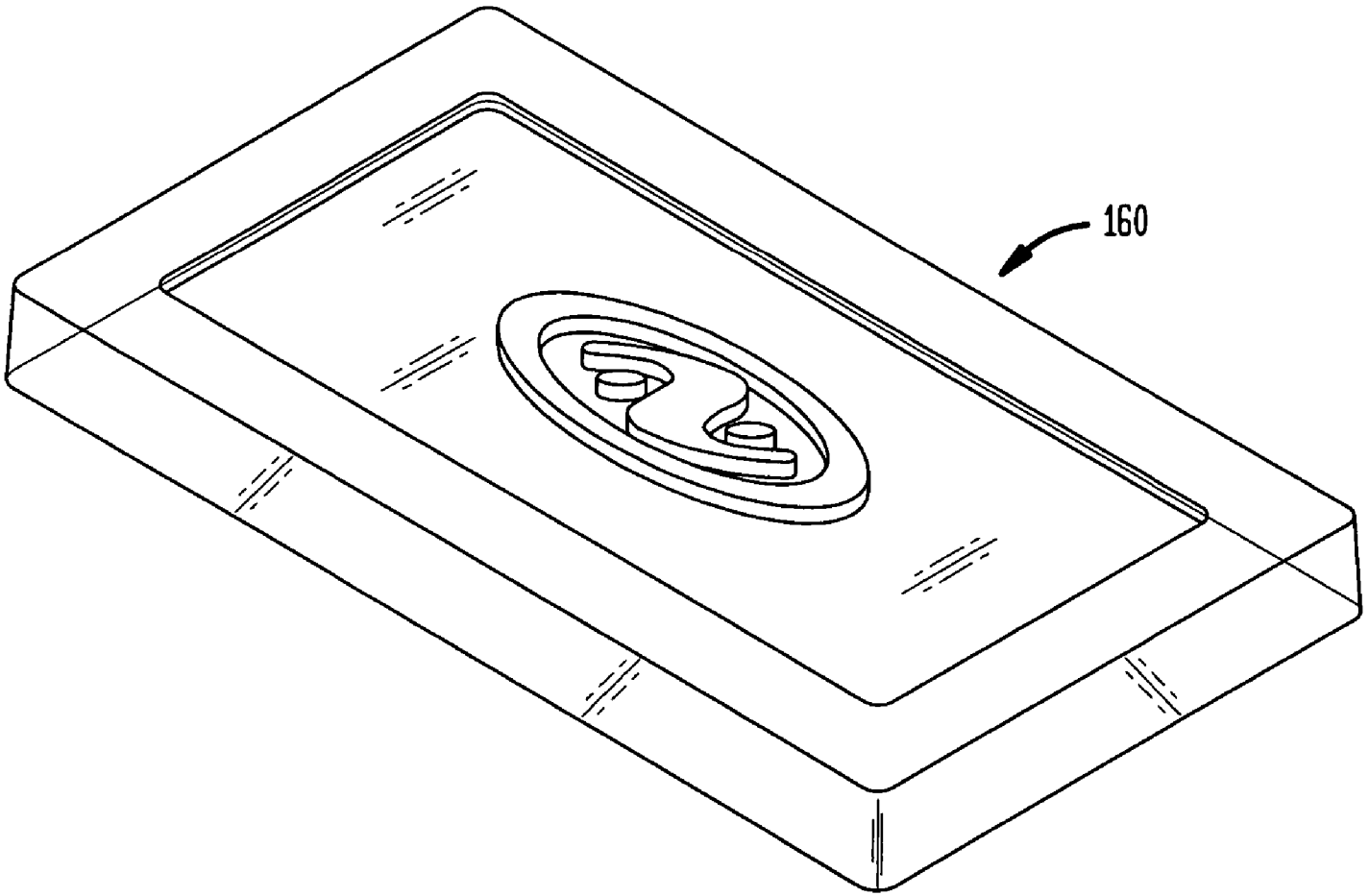

FIGS. 6 and 7 show perspective views of a box bottom 110 and lid 160 according to a further aspect of the invention. As shown in FIGS. 6 and 7, the panels in the box bottom 110 and lid 150 have been modified to form decorative shapes. However, even modified in this manner, the panels still increase the structural strength of the box and also facilitate circulation, as discussed above.

Figure 9:
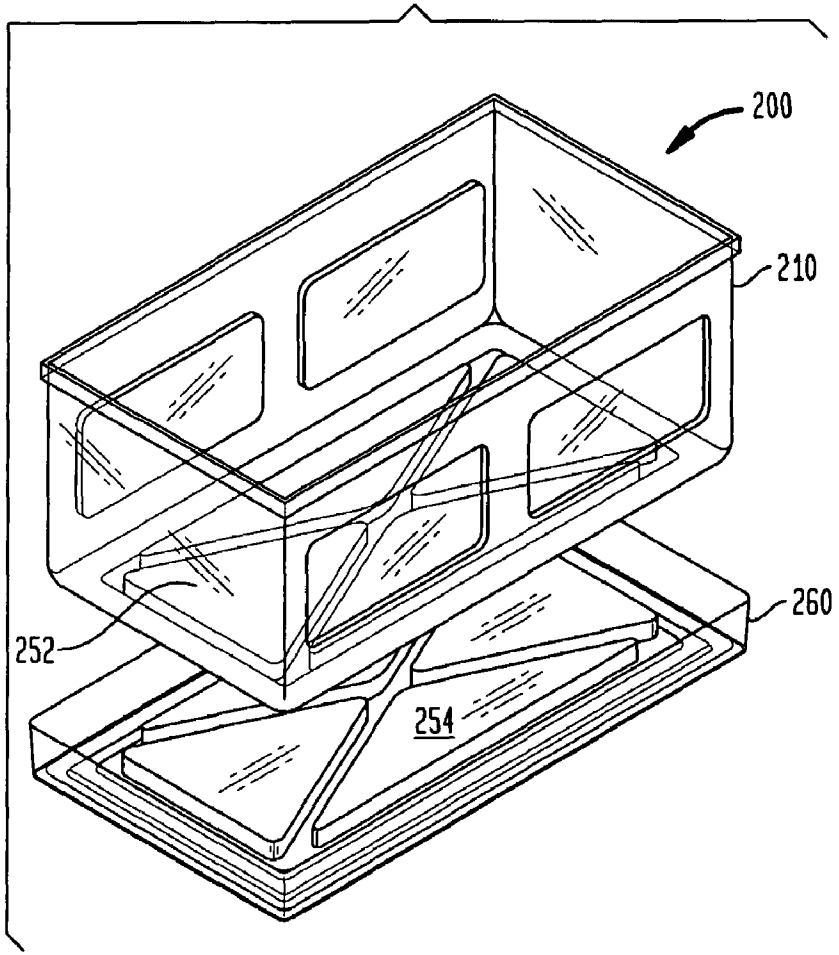
FIGS. 8 and 9 show perspective views of a box according to a further aspect of the invention.
Figure 8:
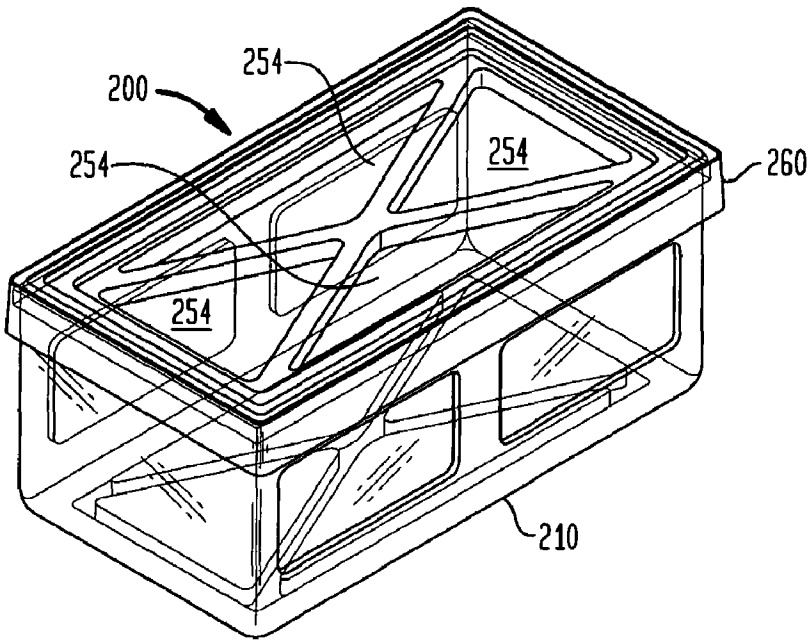

FIGS. 8 and 9 show perspective views of a box 200 according to a further aspect of the invention. The box 200 includes a box bottom 210 and a lid 260. As shown in FIG. 9, the lid 260 is shaped and dimensioned so that, after the lid 260 has been removed from the box bottom 210, the lid 260 may be positioned such that its interior face 261 abuts the bottom exterior face 211 of the box bottom 210. As described below, the box bottom 210 and lid 260 include corresponding interlocking panel indentations 252 and 254 that allow the lid 260 to be temporarily locked against the bottom face of the box bottom 210.

Figure 10:
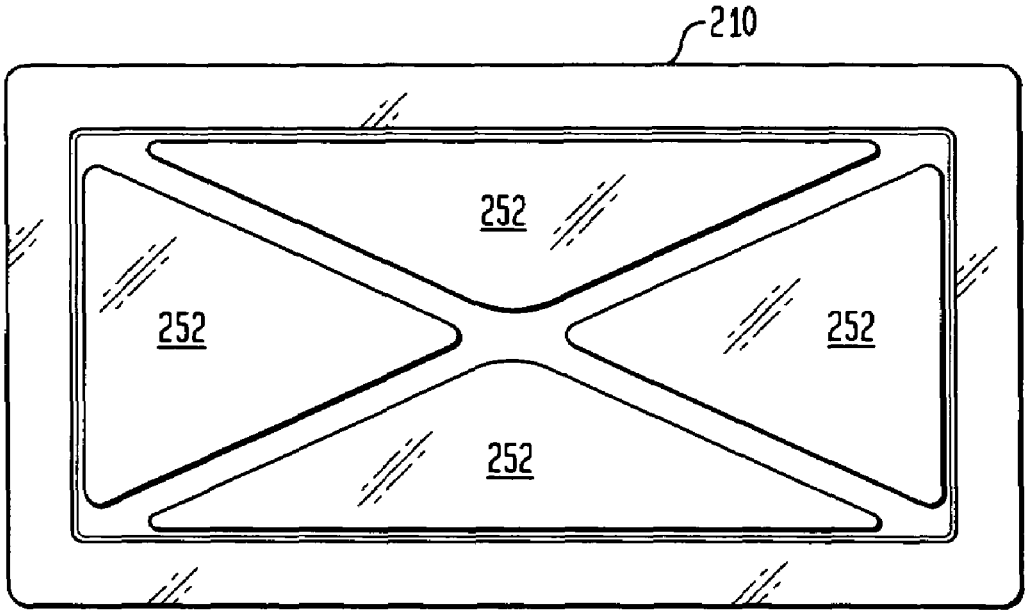
FIGS. 10–13 show, respectively, bottom, side, end, and perspective views of a box bottom according to the present aspect of the invention.
Figure 11:
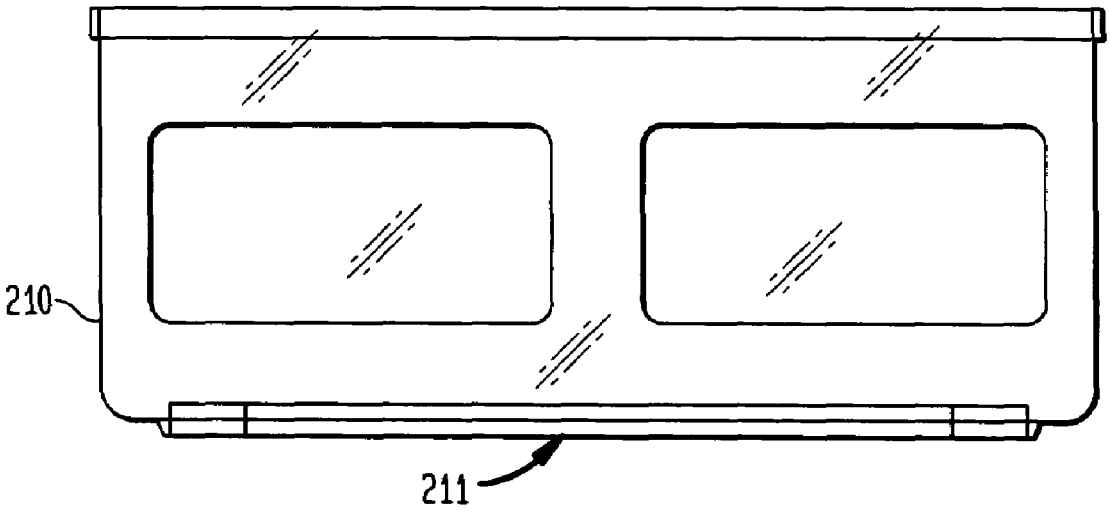
Figure 13:
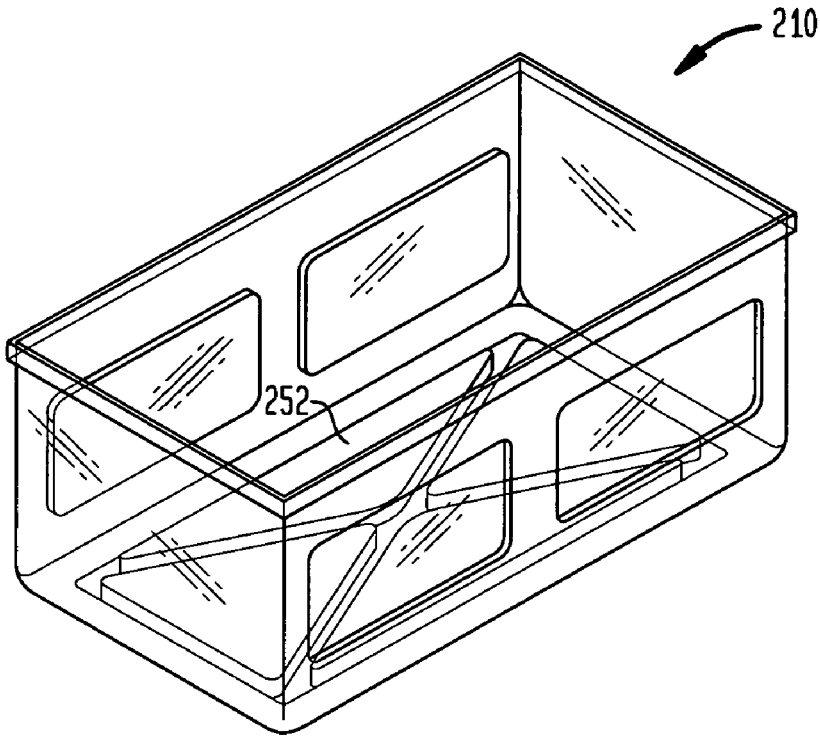
Figure 12:
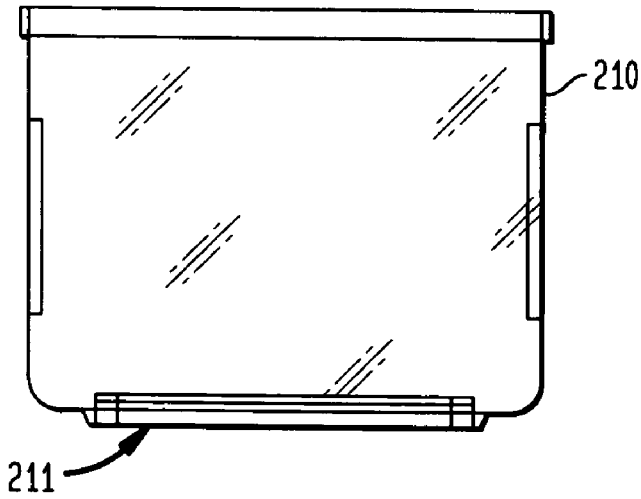

FIGS. 10–13 show, respectively, bottom, side, end, and perspective views of a box bottom 210 according to the present aspect of the invention. As shown in FIG. 10, the bottom face of the box bottom 210 includes four triangular panel indentations 252. The triangular panel indentations 252 may be suitably formed as part of a thermoforming process used to fabricate the box bottom 210. According to the present aspect of the invention, the box bottom panels 252 are indented towards the interior of the box 200.

Figure 14:
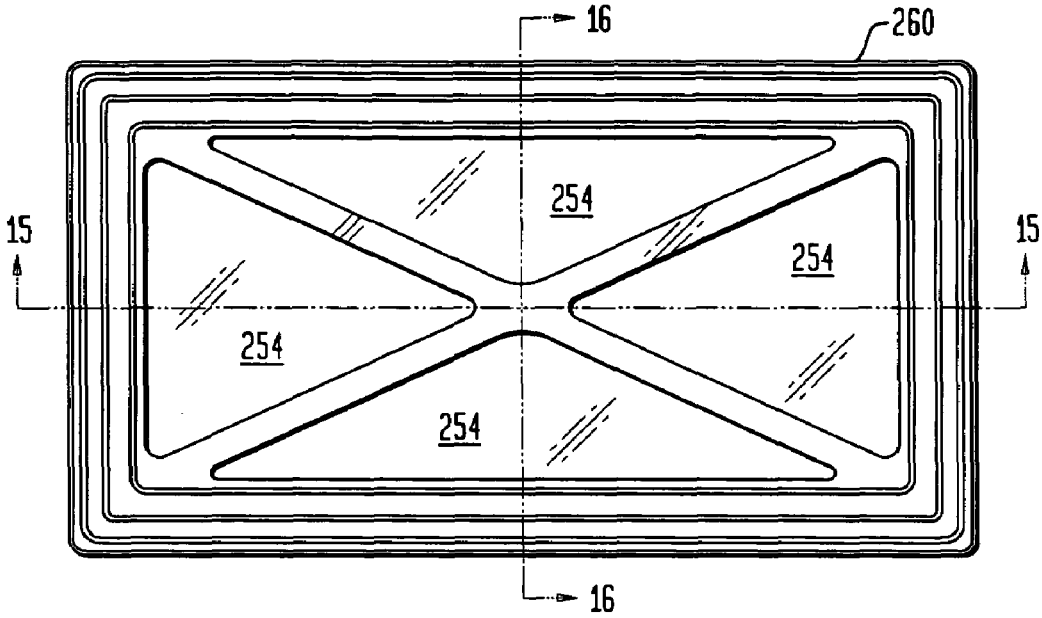
FIGS. 14–17 show, respectively, top, side, end views of a lid according to the present aspect of the invention.
Figure 15:
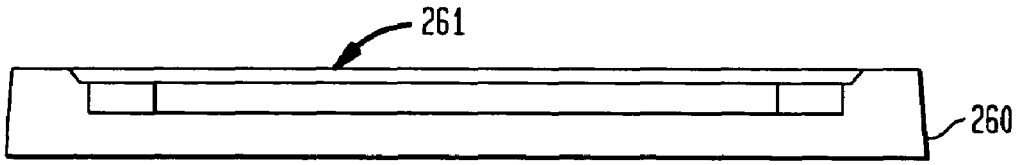
Figure 17:
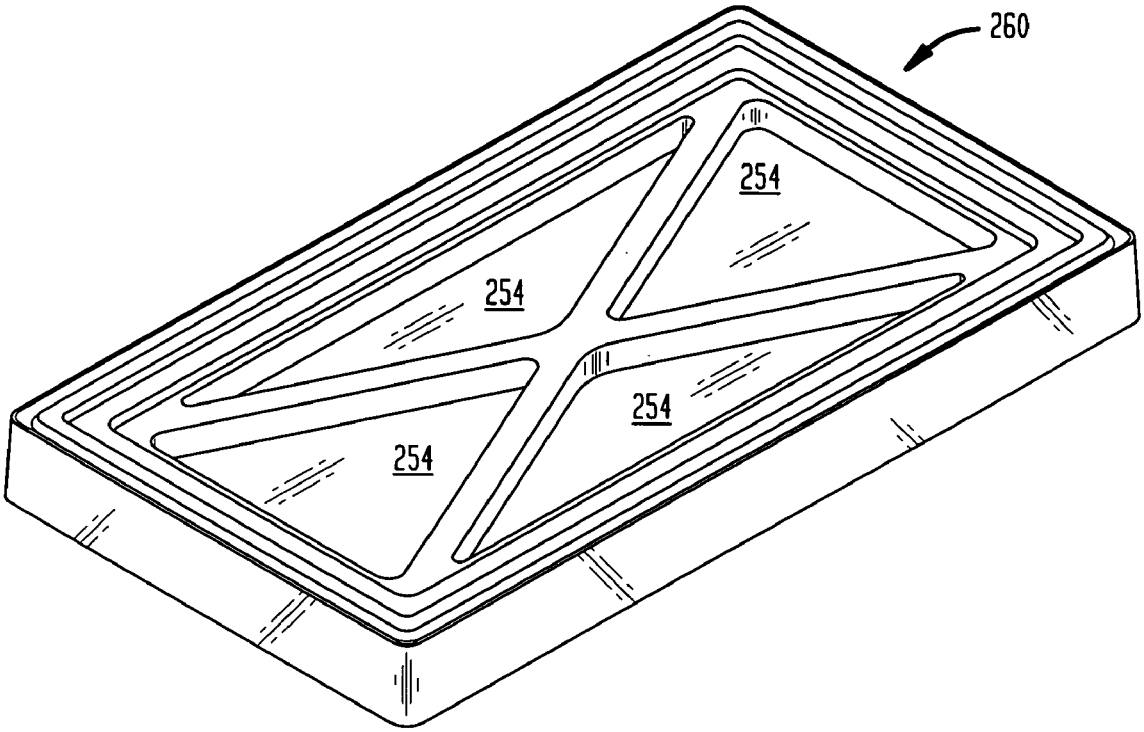
Figure 16:
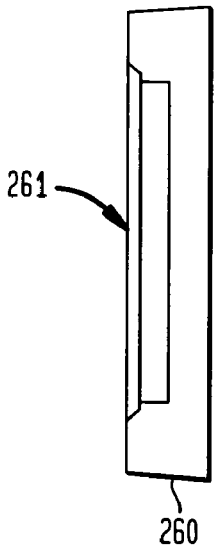

FIGS. 14–17 show, respectively, top, side, end views of a lid 260 according to the present aspect of the invention. As shown in FIG. 14, the lid 260 includes four triangular panel indentations 254. According to the present aspect of the invention, the lid panels 254 are indented towards the interior of the box 200.

It will be seen that the lid panel indentations 254 correspond in position to the four triangular panel indentations 252 shown in FIGS. 10–13. The lid panel indentations 254 are dimensioned so that they seat snugly into the box bottom panel indentations 252. Thus, when the lid 260 is positioned such that its interior face 261 abuts the bottom exterior face 211 of the box bottom 210, the lid 260 may be locked into position by seating the lid panel indentations 254 into the box bottom panel indentations 252. The lid 260 may be released from the bottom face of the box bottom 210 by simply using one's hands to pull the lid 260 free.

It should be noted that the panels 252 and 254, in addition to providing the above described locking function, also serve the functions described above with respect to the panels 52 and 54 shown in FIGS. 1 and 2. It should be further noted that the above described locking arrangement may be modified without departing from the spirit of the invention. For example, the number and shape of the panel indentations 252 and 254 may be modified, as desired. In addition, the panels 252 and 254 may be indented towards the exterior of the box 200 rather than towards the interior.

The above described locking arrangement serves a number of purposes. For example, the locking arrangement prevents a lid 260 from getting separated from its box 210. Keeping a box and lid together may be useful in certain environments, such as a shoe store, in which numerous boxes may be open at the same time. Also, locking the lid to the bottom of the box allows a box and lid to be easily transported in an open configuration. Other advantages of the locking arrangement will be apparent to a practitioner in the art.

The above described locking arrangement may suitably be combined with some or all of the other structural features described above. These features include, for example, the following elements shown in FIGS. 1–3: the cuff 66 on the lid 60, the air holes 42, 44, 46, and 48, and the supporting ridges 56 and 58.

Figure 18:
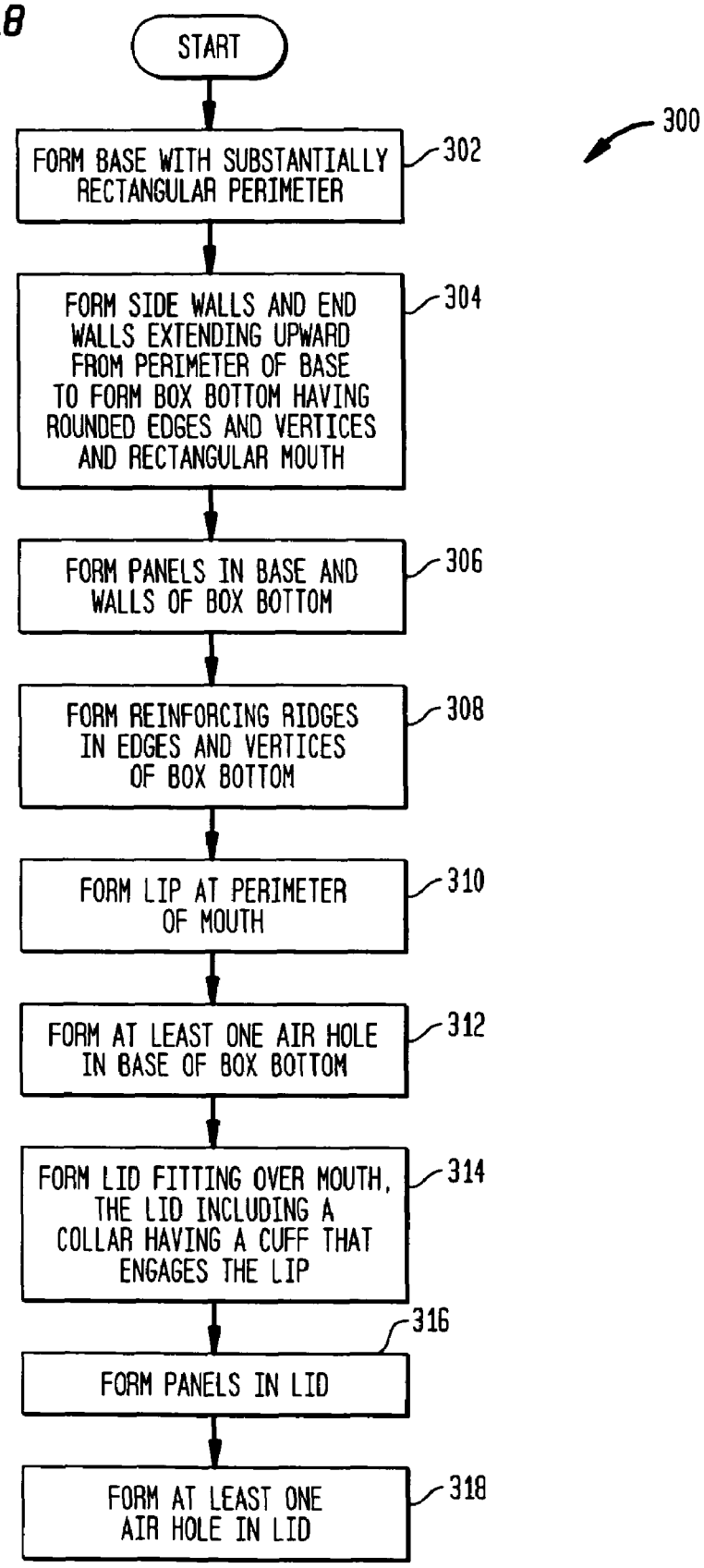
FIG. 18 shows a flowchart of a method according to a further aspect of the invention.

FIG. 18 shows a flowchart of a method 300 for fabricating a package according to a further aspect of the present invention. In step 302, a base is formed having a substantially rectangular perimeter. In step 304, side walls and end walls are formed, extending upward from the perimeter of the base to form a box bottom having rounded edges and vertices and a substantially rectangular mouth. In step 306, panels are formed in the walls and base of the box bottom. In step 308, reinforcing ridges are formed in the edges and vertices of the box bottom. In step 310, a lip is formed at the perimeter of the mouth. In step 312, at least one air hole is formed in the base of the box bottom. In step 314, a lid is formed having a collar. The collar fits over the mouth of the box bottom and includes a cuff that is dimensioned to engage the lip at the perimeter of the mouth of the box bottom. In step 316, panels are formed in the base of the lid. In step 318, at least one air hole is formed in the lid. As discussed above, a thermoforming technique may be used to form the box bottom and lid, and a punching technique may be used to form the air holes in the box bottom and lid.

It will be apparent that the above-described box bottoms and lids, and techniques for making same, may be modified without departing for the spirit of the invention. For example, the box bottom may be provided with a locking arrangement that enables the lid, once removed from the upper opening of the box bottom, to be affixed to the bottom face of the box.

In addition, the above-described boxes may be used to hold various types of retail items, including footwear, other types of clothing, or even foodstuffs. In addition, the above-described boxes may be sold separately for use in storing items or food. If desired, the box may be fabricated from a microwaveable material.

Thus, while the foregoing description includes details which will enable those skilled in the art to practice the invention, it should be recognized that the description is illustrative in nature and that many modifications and variations thereof will be apparent to those skilled in the art having the benefit of these teachings. It is accordingly intended that the invention herein be defined solely by the claims appended hereto and that the claims be interpreted as broadly as permitted by the prior art.

We claim:

1. A box, comprising:

a base having a substantially rectangular perimeter;

a pair of side walls and a pair of end walls extending upward from the perimeter of the base to form a box bottom having rounded corners and vertices, the box bottom having a mouth at the top thereof, the mouth having a substantially rectangular perimeter;

reinforcing ridges formed at the corners and vertices of the box bottom;

a lip formed at the perimeter of the mouth;

a lid fitting over the mouth of the box bottom, the lid including a collar having a cuff that engages the lip to hold the lid in position over the mouth;

at least one air hole formed in the base and in the lid; and a plurality of inwardly protruding panels formed in the walls and lid, wherein the base includes at least one panel indentation, and wherein the lid includes at least one panel indentation corresponding in position to the base panel indentation, the lid panel indentation fitting closely within the base panel indentation, such that the lid may be locked into the base by seeing the lid panel indentation into the base panel indention, the base including a plurality of base panel indentations and corresponding lid panel indentations, wherein the base panel indentations and corresponding lid panel indentations are triangular, and wherein the base panel indentations and corresponding lid panel indentations are arranged to form a rectangle.

2. The box of claim 1, wherein the lip comprises a folded-over portion of the mouth perimeter.

3. The box of claim 1, wherein the reinforcing ridges formed in the vertices include a radial ridge and a circumferential ridge, the radial ridge terminating at the circumferential ridge.

4. The box of claim 1, wherein the angle between each wall and the base is greater than 90 degrees.

5. The box of claim 1, wherein the box bottom and lid are fabricated using a thermoforming technique.

6. The box of claim 1, wherein the box bottom and lid are fabricated using a clear plastic.

* * * * *